United States Patent [19]

Koch

[11] Patent Number: 4,958,565

[45] Date of Patent: Sep. 25, 1990

[54] INFLATABLE DECELERATOR

[75] Inventor: Mark A. Koch, Sioux Falls, S. Dak.

[73] Assignee: Raven Industries, Inc., Sioux Falls, S. Dak.

[21] Appl. No.: 198,512

[22] Filed: May 25, 1988

[51] Int. Cl.[5] ..... B64D 17/80; B64D 19/00

[52] U.S. Cl. ..... 102/386; 244/113; 244/138 R

[58] Field of Search ..... 102/386; 244/3.27, 3.3, 244/138 R, 113

[56] References Cited

U.S. PATENT DOCUMENTS

| | | | |
|---|---|---|---|
| 2,819,856 | 1/1958 | Hight | 244/138 R |
| 3,123,117 | 3/1964 | Nourse et al. | 244/138 R |
| 3,145,747 | 8/1964 | Nourse et al. | 244/138 R |
| 3,313,499 | 4/1967 | Öhman | 244/3.3 |
| 3,613,580 | 10/1971 | Bench et al. | 102/386 |
| 4,005,655 | 2/1977 | Kleinschmidt et al. | 102/386 |
| 4,215,836 | 8/1980 | Zacharin | 244/138 R |
| 4,545,341 | 1/1986 | Zacharin | 244/113 |
| 4,696,443 | 9/1987 | Zacharin | 244/113 |

*Primary Examiner*—David H. Brown

*Attorney, Agent, or Firm*—Hill, Van Santen, Steadman & Simpson

[57] ABSTRACT

A decelerator structure for attachment to a munition to be deployed formed of a first triangular section of cloth with apexes and straight sides to provide a back wall and a second equally shaped and sized section of material to form a front wall with the sections joined and having scoops at the apexes on the front wall with openings inside the scoops with a central anchor on the front wall so that the walls expand equally due to inner air pressure to form a rounded rear wall and a rounded forward wall with straight sides.

11 Claims, 1 Drawing Sheet

INFLATABLE DECELERATOR

BACKGROUND OF THE INVENTION

The present invention relates to improvements in decelerators, and more particularly to an improved structure to be attached to a munition deployed from an aircraft capable of stably decelerating the descent of the munition as it drops toward the earth.

As munitions of varying sizes are deployed from aircraft, it is necessary in order to control the effective descent to reach a selected target to slow their release speed and to slow their descent. Further, a speed retarder must have the capability of slowing the speed of release and descent in a stable manner so that the trajectory and location of landing relative to a target can be calculated and determined. The release of a munition from an aircraft at high speeds will subject a deceleration device to a severe shock at the beginning of deceleration and until the speed of descent reaches a satisfactory velocity. In addition to slowing the munition from its high speed, such decelerator must continue to be effective in the stabilization mode for the remainder of the descent of the munition.

Various devices have been employed which have not been satisfactory in that many of these will fail due to the severe shock occurring with sudden retardation of speed which occurs as the munition is released from an aircraft at relatively high speed. The resultant shocks are often sufficient to cause structural failure and damage to the retarding device as well as to the munition itself. Prior art devices which are capable of retarding speed often utilized parachutes, finned stabilization and Ballute technology, but a common difficulty occurring is that the excess of speed at the time of release of the munition often over stresses the decelerator and causes it to fail. Devices based on the parachute principle will provide drag for deceleration, but upon sudden opening at high speed, will often rupture and become disoriented or break. Such devices as well as other devices which additionally stabilize the descent of the munition often fail at higher speeds and if effective at higher speeds, become ineffective and unstable at slower speeds thereby generating unstable trajectories and unstable descent patterns wherein the munition tumbles instead of descending properly.

There is a wide separation in the velocity which must be obtained for the munition in its final descent and the speed in which it is initially deployed from the airplane. Other problems which are encountered are that the decelerator may have to insure that the explosive weapon impacts the surface more nearly vertical than horizontal, and therefore a decelerator which is capable of performing this function must be reliable and predictable. It is also important that such a decelerator be relatively reasonably priced for quantity production.

In a typical mission, weapons or munitions will be deployed at sonic or supersonic speeds. At such speeds, earlier forms of decelerators such as the parachutes or metal vanes, are prone to failure and have proven not to be acceptable. In the development of decelerators, the concept of a closed inflatable decelerator was pioneered by Goodyear Aerospace Corporation as a Ballute. This balloon-like device is capable of being packed in a compartment in the rear of the munition such as a 500 pound bomb. Upon release from the aircraft, the Ballute is released and the air is scooped into the device through inlets in its side. The size of the inflation is determined by the drag force which is required for the particular application. Simple rounded shapes tend to be unstable in an airflow, so inflatable decelerator designs must include a turbulence generator, often referred to as a "burble fence". Decelerators of this large type have been in production over the years and serve certain circumstances, but are not satisfactory for all applications.

Another form of decelerator which has been developed is a smaller version which is used to slow small bomblets which are typically released in large quantity from unitized containers. Because the needed quantities range into the millions, the decelerators must be very simple and inexpensive. One form of decelerator which has been developed for the foregoing purposes is disclosed in U.S. Pat. No. 4,565,341. This structure incorporates a pseudo-conical forward surface and an essentially flat rearward surface. The requirements of this structure make it difficult to manufacture and too expensive for many applications, and the structure of the present invention has been discovered to provide advantages in manufacture and performance over a structure such as that disclosed in the aforesaid patent.

FEATURES OF THE INVENTION

Accordingly, an object of the present invention is to provide an improved decelerator structure which attains improved airflow patterns around it so that increased stability, strength and deceleration objectives are obtained.

A further object of the present is to provide an improved inflatable decelerator made of fabric wherein the structural design enables mass production manufacturing at a less expensive unit cost and wherein a uniformity of performance can be attained.

A still further object of the invention is to provide an improved decelerator structure which has improvements in design over structures heretofore available in that improved and more stable deceleration can be obtained and wherein the structure can be manufactured at a lower unit cost than structures heretofore available.

In accordance with the principles of the present invention, a decelerator structure is made from two flat triangular pieces of material of the same size. The geometry employed utilizing triangular pieces for both the front and rear wall of the structure wherein the sides of the triangle are linear between the apexes enables manufacture from a length of fabric of the front and back walls of many decelerators with essentially no waste of material. This structure design additionally has been found to obtain improved airflow in that the triangular front and back walls expand essentially uniformly as the chamber therebetween is inflated by flow-through holes in the end of the apexes. Scoops are located at the ends of the apex to channel air into the holes. The tips of the apexes are rounded and the triangles are joined by stitching, preferably in parallel dual rows parallel to the edge of the fabric which provides for a smoothly contoured scoop. The inflation characteristics can be modified by the size and placement of the inlet holes and by the amount of rise which is built into the scoop material. The scoop material is conveniently attached by the same stitching which joins the front and rear walls. It has been found that a straight sided equilateral triangle reduces stress concentration and apparently improves airflow characteristics for improved deceleration. By providing stitching adjacent the edge around the circumference, the material which is upward from the stitching provides a turbulence generator to enhance stability.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENT

Figure 1:
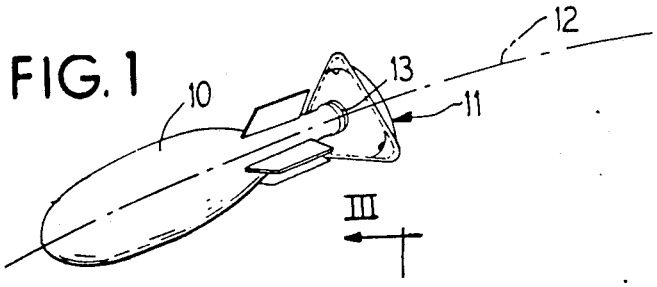
FIG. 1 is a somewhat schematic perspective view of a munition being deployed from an aircraft with a decelerator structure constructed and operated in accordance with the principles of the present invention attached to the trailing end of the munition.

FIG. 1 illustrates a munition such as a small bomblet 10 which is released from an aircraft and has a decelerator 11 of the construction of the present invention attached to the munition by an attachment means 13. Upon deployment at high speed, the decelerator 11 will function to stably slow the descent of the bomblet and its trajectory is shown schematically by the broken line 12.

Figure 2:
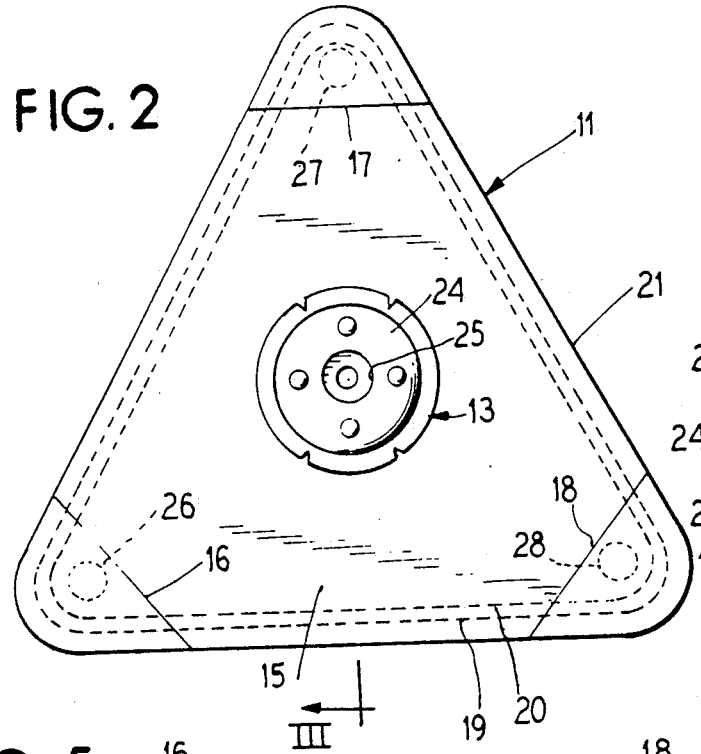
FIG. 2 is a plan view of the decelerator.
Figure 3:
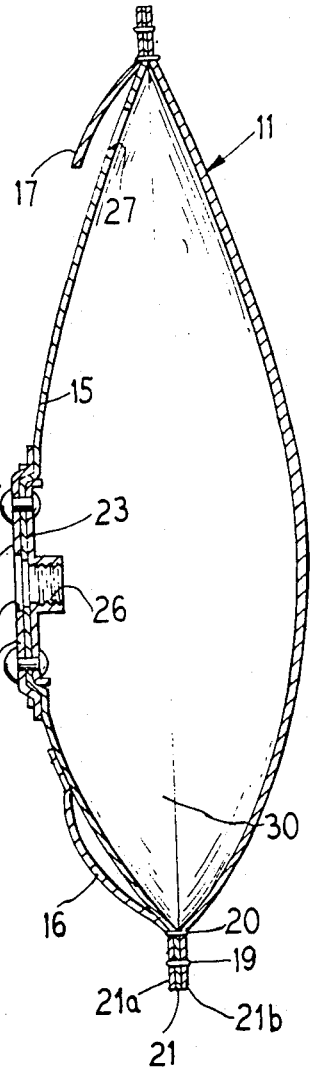
FIG. 3 is a vertical sectional view taken substantially along line III—III of FIG. 2.
Figure 5:
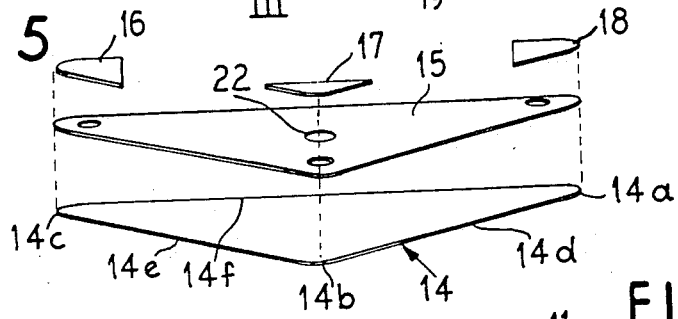
FIG. 5 is an exploded schematic view illustrating parts which go into construction of the decelerator.
Figure 4:
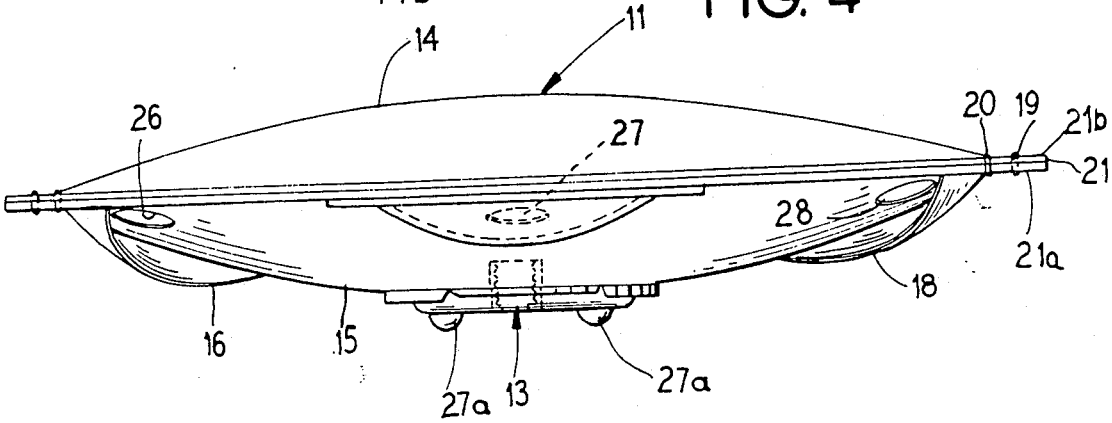
FIG. 4 is a side elevational view of the decelerator.

FIG. 5 illustrates the manner of construction and the material used in making the decelerator as it appears in its completed form in FIGS. 2 through 4.

The first triangular section of fabric 14 provides the rear wall of the decelerator. A second triangular shaped section 15 of fabric of the same size and shape as the rear wall 14 is provided. The sections are equilateral triangularly shaped with apexes 14*a*, 14*b* and 14*c* which are rounded. The triangles have linear straight sides 14*d*, 14*e* and 14*f*. Because of the straight sides, it will be obvious that a pattern layout can be provided in a continuous sheet of fabric material which has substantially no waste thereby effecting a saving in cost of manufacture when thousands of the decelerators are made. Also, the rear wall 14 and front wall 15 being of the same size and shape can be manufactured together increasing the work and layout of the fabric walls.

The front wall 15 is provided with a circular opening 22 at the center for an anchoring means having a construction such as illustrated in FIGS. 2 through 4.

At the apexes of the front wall are inwardly directed scoops 16, 17 and 18 which are formed of rounded ends triangular small sections of fabric of the same material as the walls 14 and 15.

In assembly of the fabric walls illustrated in FIG. 5, the front wall is overlaid in the rear wall 14; the scoops 16, 17 and 18 are laid on the apexes of the triangular material and stitching illustrated by the rows of stitches 19 and 20 joins the layer of fabric. The scoops are provided to be slightly larger across than the material of the wall so that they are rounded to provide scoops for capturing air as the decelerator moves forwardly. Within the scoops circular holes 26, 27 and 28 are provided in the apexes of the front wall 15. These circular openings provide passages to admit air into the interior chamber formed between the attached front and rear walls of the decelerator.

A flat rigid plate 23 is located inside of the opening 22 in the forward wall 15 and a matching plate is placed outside of the wall with rivets 27*a* extending through holes in the plates to clamp the plates against the material. The forward plate 24 has a central opening 25, and the inner plate 23 has an interior or threaded boss 26 for receiving a bolt or other threaded member for attachment of the decelerator to the munition.

The decelerator as assembled can be stacked flat so that many of the decelerators can be packed in a carton for ease of shipping and storage. When used, a decelerator can be quickly attached to the tail-end of the munition by a threaded connector threaded into the boss 26.

A significant feature of the decelerator is the manner of attachment of the rear and forward panel walls 14 and 15 by stitching which is at the outer peripheral edge, but spaced inwardly therefrom so as to leave a raw edge 21. Preferably, two rows of stitching 19 and 20 are employed, although other suitable bonding means can be used, the stitching providing the preferred structure for attaching the fabric inasmuch as it provides a secure attachment and permits leaving the raw peripheral area 21. This peripheral area has been found to have an effect on the airflow acting as a turbulence generator to enhance stability. This border area and the material which is incorporated into the stitching contributes to the turbulence generating function to enhance the stability of the decelerator in flight.

In flight the air scoops channel air in through the openings 26, 27 and 28 so that the chamber 30 between the forward and rear panels inflates to essentially the same size and shape on the forward and rear side of the decelerator.

The material for the walls is preferably of a low porosity fabric and the decelerator is made essentially of two flat triangular equal sided pieces of material. The inflation characteristics can be modified by the size and placement of the inlet holes 26, 27 and 28 as well as by the amount of rise which is built into the scoop material 16, 17 and 18. The triangular walls have linear edges with straight sides. The rounded tips on the apexes of the walls allow for smooth and effective scoop shaping but also are advantageous relative to the manufacturing process in that they allow for rapid assembly on semi-automatic sewing equipment.

The rounded tips combined with the flat portions formed by the stitching and the periphery outside of the stitching provides a turbulence generator which enhances stability. The structure is simple and inexpensive yet reliable and with the construction, manufacturing quantities which will run into the millions are practical and feasible. The foregoing design and its operation achieves the advantages above set forth and obtains a decelerator structure which achieves optimum stability and deceleration force for weight and size.

I claim as my invention:

1. A deceleration structure for attachment to a munition to be deployed from an aircraft comprising in combination:

a triangular shaped rear wall of flexible material;

an identically shaped and sized triangular forward wall of flexible material with the triangle having apexes and linear walls between the apexes;

means defining an opening in the forward wall in each of the apexes;

bonding means joining the edges of said walls along their full periphery;

a centrally located anchoring means in said forward wall; and scoops facing inwardly on the forward wall and extending over said opening means in each apex channeling air inwardly through said opening means into the space between said walls whereupon said walls expand an equal amount to form a rounded rear wall and a rounded forward wall for the flow of air into the chamber between the wall and the flow of air around the outer surfaces of the wall.

2. A decelerator structure for attachment to a munition to be deployed from an aircraft constructed in accordance with claim 1:

wherein said shaped rear wall and said shaped forward wall are formed of a nonporous cloth.

3. A decelerator structure for attachment to a munition to be deployed from an aircraft constructed in accordance with claim 1:

wherein said forward wall is a centrally located circular opening with rigid circular plates of a diameter larger than the opening an opposing sides of the forward wall providing said anchoring means.

4. A decelerator structure for attachment to a munition to be deployed from an aircraft constructed in accordance with claim 1:

wherein said bonding means is in the form of dual rows of stitching extending parallel to the periphery of the walls.

5. A decelerator structure for attachment to a munition to be deployed from an aircraft constructed in accordance with claim 4:

wherein said stitching joins said scoops to the outer surface of the forward wall.

6. A decelerator structure for attachment to a munition to be deployed from an aircraft comprising in combination:

a first equilateral triangular shaped section of fabric with rounded apexes and straight sides between said apexes;

a second equilateral triangular shaped section of fabric with rounded apexes and straight sides between said apexes and being of the same size as said first section of fabric;

means defining openings through said section of fabric at the apexes for admitting air into the chamber between said fabric sections;

fabric scoops projecting over said openings at the apexes facing inwardly for channeling air into the openings;

stitching extending peripherally on the sections of fabric and joining the sections of fabric and the scoops to each other; and attachment means centrally located in the second section of fabric so that the opening means are equidistant from the attachment means and air flowing through said opening means creates an equal force effect relative to the attachment means for a decelerating effect due to air flowing past the joined sections of fabric.

7. A decelerator structure for attachment to a munition to be deployed from an aircraft constructed in accordance with claim 6:

wherein the sections of fabric are joined by parallel lines of double stitching.

8. A decelerator structure for attachment to a munition to be deployed from an aircraft constructed in accordance with claim 6:

wherein said stitching is round at the tips of said apexes are rounded.

9. A decelerator structure for attachment to a munition to be deployed from an aircraft constructed in accordance with claim 6:

wherein said attachment means includes rigid plates on opposing sides of the second section of fabric and centrally located relative thereto.

10. A decelerator structure for attachment to a munition to be deployed from an aircraft constructed in accordance with claim 9:

wherein the inner of the plates is threaded to receive an anchoring means.

11. A decelerator structure for attachment to a munition to be deployed from an aircraft comprising in combination:

a first equilateral triangularly shaped section of fabric with rounded apexes and straight sides between said apexes;

a second equilateral triangularly shaped section of fabric with rounded apexes and straight sides between said apexes being of equal size and shape to the first section;

means defining openings at the apex of the second section;

scoops at the apexes facing inwardly directing a flow of air through said opening means;

attachment means centrally located in the second section of fabric; and stitching extending around the entire periphery of the fabric sections and joining the fabric sections and spaced inwardly from the outer edge of the sections of fabric so that the projecting outer edge constitutes a turbulence generator enhancing stability of the decelerator structure.

* * * * *